US006869030B2

(12) United States Patent
Blessing et al.

(10) Patent No.: US 6,869,030 B2
(45) Date of Patent: Mar. 22, 2005

(54) SHOWER HEAD

(75) Inventors: Gerhard Blessing, VS-Obereschach (DE); Franz Schorn, Schiltach (DE)

(73) Assignee: Hansgrohe AG, Schiltach (DE)

( * ) Notice: Subject to any disclaimer, the term of this patent is extended or adjusted under 35 U.S.C. 154(b) by 97 days.

(21) Appl. No.: 10/058,491

(22) Filed: Jan. 28, 2002

(65) Prior Publication Data

US 2002/0100818 A1 Aug. 1, 2002

(30) Foreign Application Priority Data

Jan. 27, 2001 (DE) ..... 101 03 649

(51) Int. Cl.[7] ..... A62C 31/02

(52) U.S. Cl. ..... 239/394; 239/390; 239/391; 239/392; 239/393; 239/396

(58) Field of Search ..... 239/394, 390, 239/391, 392, 393, 396, 443, 437, 440, 441, 444, 447, 448, 449

(56) References Cited

U.S. PATENT DOCUMENTS 4,346,844 A * 8/1982 Harmony ..... 239/381
4,657,185 A * 4/1987 Rundzaitis ..... 239/438
5,129,584 A * 7/1992 Ridenour ..... 239/579
5,862,985 A * 1/1999 Neibrook et al. ..... 239/99
5,961,046 A * 10/1999 Joubran ..... 239/107
6,230,989 B1 * 5/2001 Haverstraw et al. ..... 239/443

FOREIGN PATENT DOCUMENTS

| | | | |
|---|---|---|---|
| DE | 78 35 426 | 4/1979 | |
| DE | 79 20 406 | 10/1979 | |
| DE | 44 15 785 | 1/1998 | |
| EP | 05 14 752 | 5/1992 | |
| GB | 2068778 A * | 8/1981 | ..... B05B/1/12 |
| GB | 21 92 564 | 4/1987 | |

OTHER PUBLICATIONS

Copy of German Search Report.

* cited by examiner

*Primary Examiner*—Davis Hwu
(74) *Attorney, Agent, or Firm*—Duane Morris LLP

(57) ABSTRACT

A shower head, which can e.g. be the shower head of a hand shower, contains a jet discharge disk with two groups of jet outlets. The first group of jet outlets is continuously in operation and delivers an aerated jet. A second group of jet outlets can be switched in to said first group of jet outlets with the aid of a switching device.

13 Claims, 1 Drawing Sheet

SHOWER HEAD

Figure 1:
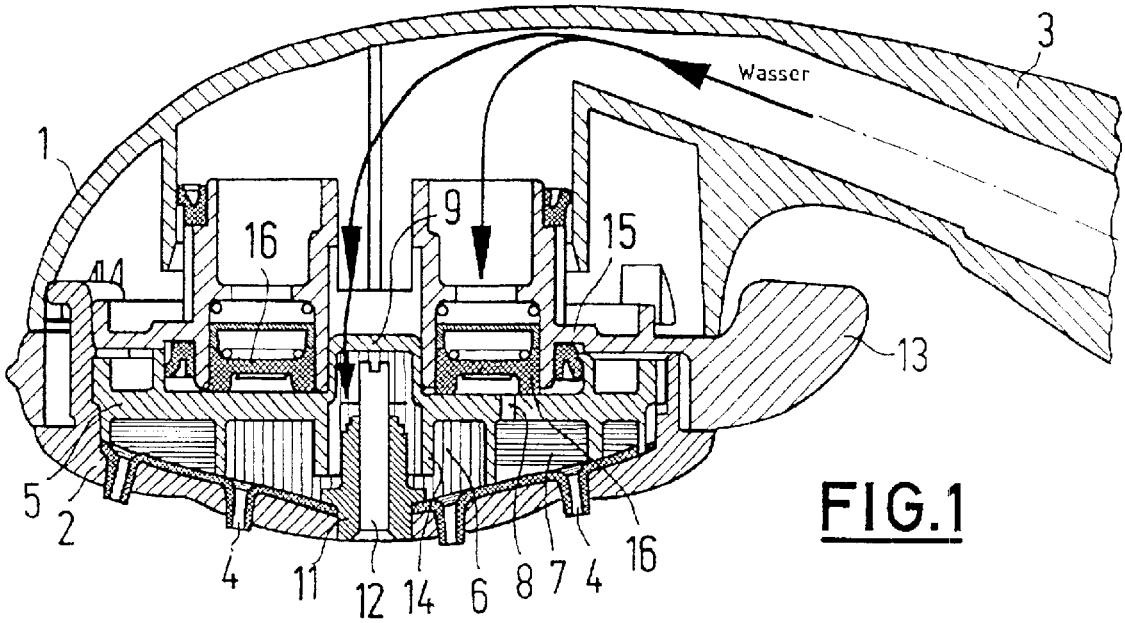

The invention is directed at a shower head. Shower heads of the most varied types are known. There are also shower heads with switching or changeover devices, either in order to switch or change between different jet types, or in order to temporarily reduce the amount of water to be delivered.

It is also known to provide aerated jets, which optically give the impression of a full water jet, even if the amount of water forming the jet is smaller than it appears.

The problem of the invention is to provide a shower, which gives the user the feeling of a satisfactory showering action despite a low water consumption.

This problem is solved by a shower head according to the present invention.

The aerated water jet discharged from the first group of jet outlets, is according to the invention the water jet which is always switched on, as soon as the shower is put into operation. Thus, it is not an additional connectable jet, but instead the jet in the normal position. Thus, in the case of a lower water consumption, both optically and from the feeling imparted to the user, the impression is given that he is showering with a full jet. With the aid of the switching device he can now connect or switch in to this adequate jet the at least one further group of jet outlets, so as to create a stronger or more water-carrying jet.

According to a further development of the invention both groups of jet outlets are connected with in each case one chamber in the shower head housing. This makes it possible to relatively simply supply with water several jet outlets in each jet outlet group whilst involving little effort and expenditure.

According to a further development of the invention, the switching device or in other words the switching in device opens or closes the water inlet in the chamber associated with the jet outlets.

According to a further development of the invention, aeration takes place within the housing. Whereas the known water jet aerators are normally positioned outside the shower head housing, according to the invention aeration takes place within the housing, so that there are no conspicuous parts outside the housing.

It can in particular be provided that air for aeration purposes is sucked through an opening in the jet disk. It is possible for a tube or a tubular projection to extend from the opening in the jet disk into the interior of the housing or the associated chamber to such an extent that it is reliably ensured that no water passes out of said opening and instead it only serves for the suction of air.

According to a further development of the invention, the first group of jet outlets is radially positioned within the jet outlets of the second group. By concentrating the aerated jet passing out of the jet outlets of the first group roughly in the centre of the jet disk, it is indicated that it is the main jet.

For switching or switching in the second or a third group of jet outlets, according to the invention a manually operated device can be provided, which is e.g. directed located on the edge of the shower head.

According to the invention, said switching device after a certain time is automatically returned to the normal position. Preferably at least one of the switched in jet groups has no aeration.

According to the invention it can be provided that the seal between the chambers is at least partly formed by the jet disk, particularly an inner lining of said jet disk made from an elastomeric material.

According to the invention it can be provided that the ratio of through-flows of both groups of jet outlets is greater than 2:1 and the group of jet outlets continuously in operation has the smaller through-flow.

The jet disk and the housing can be radially and axially mutually fixed.

The switching device can be positioned between the housing and the jet disk.

Further features, details and advantages of the invention can be gathered from the following description of a preferred embodiment of the invention, the claims and the attached drawings, wherein show:

FIG. 1 A section through a shower head according to the invention.

Figure 2:
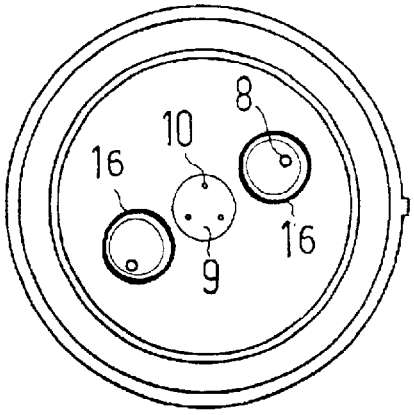

FIG. 2 On a reduced scale compared with FIG. 1, a representation with switched off, second group of jet outlets.

Figure 3:
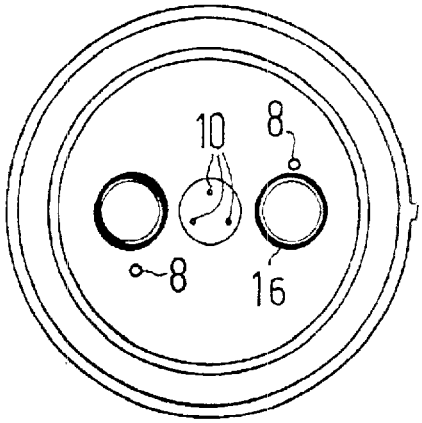

FIG. 3 A representation corresponding to FIG. 2 in which the jet outlets of the second group of outlets is in operation.

Figure 4:
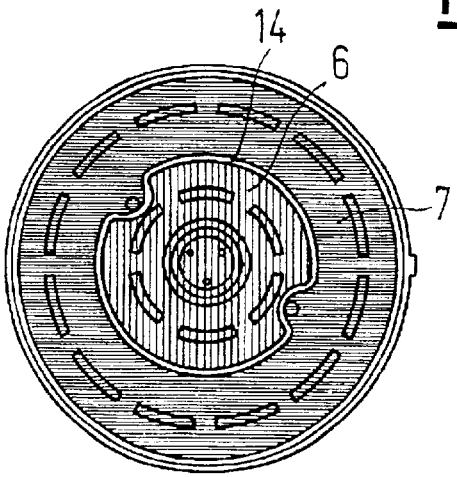

FIG. 4 A cross-section through the shower head in the same scale as FIGS. 2 and 3.

FIG. 1 shows a section through a shower head. The shower head contains a housing 1, which is terminated to the outside by a jet discharge disk 2. Into the shower head housing 1 passes e.g. through a grip or handle 3 a water supply pipe. The shower head contains numerous jet outlets 4 combined into groups and which can e.g. be constructed as nozzles from elastomeric material. The jet discharge disk 2 can e.g. be retained in the shower head housing 1 with the aid of catches.

In the housing and at a certain distance from the jet discharge disk 2 is provided an intermediate base member 5, which together with the jet disk 2 forms two sealed chambers 6, 7 in the embodiment shown. In the same way as into the outer chamber 7, water inlets lead into the radially inner chamber 6. The section of FIG. 1 shows a water inlet 8 leading into the outer chamber 7.

The intermediate base member 5 contains in its centre a boss 9 directed into the interior of the shower head housing 1 and in which there are three water inlets 10 in the form of narrow bores, cf. particularly also FIGS. 2 and 3. The diameter of the inlets 10 is very small, so that here there is a very high flow rate. From the outside of the jet discharge disk 2 a tubular projection 11 with an inner opening 12 leads into the inner chamber 6 and extends to just in front of the base of the boss 9. Through said inner opening 12 air can pass into the interior of the inner chamber 6. As a result of the very strong and rapid flow through the openings 10, a vacuum occurs there permitting the suction of air through the opening 12, so that an air-water mixture is formed within the chamber 6. This air-water mixture passes out of the jet disk 2 through the jet outlets 4 of the inner group of jet outlets. The openings 10 in boss 9 are continuously opened, so that the inner chamber 6 is always in operation.

On the side of the intermediate base member 5 remote from the jet discharge disk 2 is rotatably mounted a rotary slide valve 15, which retains in cylindrical mounting supports two sealing sleeves 16, which engage in sealing manner on the side of the intermediate base member 5 directed into the interior of the shower head. In the position shown in FIG. 2 the water inlets 8 for the outer chamber are located in the area sealed by the sealing sleeves 16. In other words the water inlets 8 into the outer chamber 7 are closed. The water only passes through the openings 10 into the inner chamber 6 and from there into the open. If the rotary slide valve 15 is now turned with the aid of the operating handle 13, the sealing sleeves 16 pass into a position shown in FIG. 3. Both water inlets 8 for the outer chamber 7 are now free, so that water can pass from the interior of the shower head housing 1 into the outer chamber 7. From there it flows through the outer group of jet outlets 4 into the open. This jet passing out of said jet outlets is not aerated.

The separation between the inner chamber 6 and the outer chamber 8 is provided by a partition 14, whose path is shown in FIG. 4. In the vicinity of the water inlets 8, the partition 14 makes an inwards bulge, which is also visible in FIG. 4. The section of FIG. 1 to the right of the centre is located in such a bulge.

What is claimed is:

1. Shower head having a housing, a jet disk terminating the housing, at least two groups of jet outlets whereof one group is continuously in operation and delivers an aerated jet, and a second group of the jet outlets can be switched in by a switching device, wherein a ratio of through-flows between the second group of jet outlets and the first, continuously operating group of jet outlets is higher than 2:1.

2. Shower head according to claim 1, wherein both groups of jet outlets are connected to in each case one chamber in the housing.

3. Shower head according to claim 2, wherein a seal between the chambers is at least partly formed by the jet disk, including a lining of said jet disk made from elastomeric material.

4. Shower head according to claim 1, wherein the switching device opens or closes the water inlet into the chamber associated with the jet outlets.

5. Shower head according to claim 1, wherein aeration takes place within the housing.

6. Shower head according to claim 1, wherein the air is sucked through an opening in the jet discharge disk.

7. Shower head according to claim 6, wherein a tubular projection extends into the chamber from the opening in the jet discharge disk.

8. Shower head according to claim 1, wherein the first group of jet outlets is arranged radially within the arrangement of jet outlets of the second group of jet outlets.

9. Shower head according to claim 1, wherein the switching device is manually operated.

10. Shower head according to claim 1, wherein the switching device is automatically reset.

11. Shower head according to claim 1, wherein the jet disk and housing are radially and axially mutually fixed.

12. Shower head according to claim 1, wherein the switching device is positioned between the jet disk and the housing.

13. Shower head according to claim 1, having markings for indicating the position of the switching device.

* * * * *